US008331829B2

(12) United States Patent
Mase et al.

(10) Patent No.: US 8,331,829 B2
(45) Date of Patent: Dec. 11, 2012

(54) DEVELOPER CARTRIDGE, DEVELOPING UNIT AND IMAGE FORMING APPARATUS INCLUDING THE SAME

(75) Inventors: Soichiro Mase, Handa (JP); Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1064 days.

(21) Appl. No.: 12/035,527

(22) Filed: Feb. 22, 2008

(65) Prior Publication Data

US 2008/0205940 A1 Aug. 28, 2008

(30) Foreign Application Priority Data

Feb. 27, 2007 (JP) ..... 2007-047474

(51) Int. Cl.
*G03G 15/08* (2006.01)

(52) U.S. Cl. ..... 399/258; 399/120; 399/263

(58) Field of Classification Search ..... 399/258
See application file for complete search history.

(56) References Cited

U.S. PATENT DOCUMENTS

| | | | | |
|---|---|---|---|---|
| 5,913,097 | A * | 6/1999 | Nakano et al. | 399/256 |
| 6,456,810 | B1 | 9/2002 | Deguchi et al. | |
| 6,526,245 | B1 * | 2/2003 | Yamashita | 399/254 |
| 6,553,202 | B2 * | 4/2003 | Tamaki et al. | 399/258 |
| 7,899,367 | B2 * | 3/2011 | Fukuta | 399/254 |
| 2005/0008400 | A1 * | 1/2005 | Tazawa et al. | 399/263 |
| 2009/0087222 | A1 * | 4/2009 | Mase et al. | 399/255 |

FOREIGN PATENT DOCUMENTS

| | | | |
|---|---|---|---|
| JP | 4-44651 | U1 | 4/1992 |
| JP | 9-134065 | A | 5/1997 |
| JP | 9-244375 | A | 9/1997 |
| JP | 09-319202 | | 12/1997 |
| JP | 10-293460 | A | 11/1998 |
| JP | 2001-27840 | A | 1/2001 |

OTHER PUBLICATIONS

JP Office Action dtd Mar. 5, 2009, JP App. 2007-047474, partial translation.

* cited by examiner

*Primary Examiner* — David Gray
*Assistant Examiner* — Andrew Do
(74) *Attorney, Agent, or Firm* — Banner & Witcoff, Ltd.

(57) ABSTRACT

A developer cartridge includes a cartridge cabinet including a developer accommodating chamber configured to accommodate developer, and a supply opening that is provided in one wall surface and is configured to supply the developer from an inside of the developer accommodating chamber to an outside of the developer accommodating chamber, a rotational shaft that is rotatably supported in the cartridge cabinet, extends parallel to the one wall surface and extends through the inside of the developer accommodating chamber, an agitating blade that is supported by the rotational shaft and rotates with the rotational shaft to supply the developer toward the supply opening while agitating the developer, and an obstruction member that is supported by the rotational shaft and rotates with the rotational shaft following the agitating blade to obstruct the supply opening during rotation of the rotational shaft.

13 Claims, 11 Drawing Sheets

DEVELOPER CARTRIDGE, DEVELOPING UNIT AND IMAGE FORMING APPARATUS INCLUDING THE SAME

CROSS-REFERENCE TO RELATED APPLICATIONS

This application claims priority from Japanese Patent Application No. 2007-047474 filed on Feb. 27, 2007, the entire subject matter of which is incorporated herein by reference.

TECHNICAL FIELD

Aspects of the present invention relate to an image forming apparatus, a developing unit, and a developer cartridge mounted in the image forming apparatus for supplying developer.

BACKGROUND

There has been proposed a laser printer including a toner replenishment method for replenishing a developing device from a toner cartridge with toner (for example, see JP-A-9-319202).

In the laser printer including the toner replenishment method, the toner cartridge is configured attachably to and detachably from an inside of the developing device. In a state of attaching the toner cartridge to the developing device, an inside of the toner cartridge communicates with an inside of a developing chamber of the developing device by a toner supply opening provided in a center in a width direction of the toner cartridge and by toner suction openings provided on both sides of the supply opening. An agitator for supplying toner from the toner supply opening to the inside of the developing chamber while agitating the toner is disposed inside the toner cartridge. Inside the developing chamber, a developing roller, a supply roller for supplying toner to the developing roller, and a developer transport member for transporting toner are arranged. The toner supplied from the toner supply opening to the inside of the developing chamber is transported from the toner supply opening toward each of the toner suction openings on either side of the supply opening of the toner cartridge by the developer transport member of the developing chamber. Then, the toner is returned from each of the toner suction openings to the inside of the toner cartridge. Consequently, the toner can be deposited uniformly along the whole supply roller while the toner circulates between the toner cartridge and the developing chamber, and the toner is prevented from being retained in a part of the inside of the developing chamber.

SUMMARY

Aspects of the present invention provide a developer cartridge, a developing unit and an image forming apparatus capable of efficiently supplying developer from a developer accommodating chamber to an outside thereof.

DETAILED DESCRIPTION

<General Overview>

Figure 1:
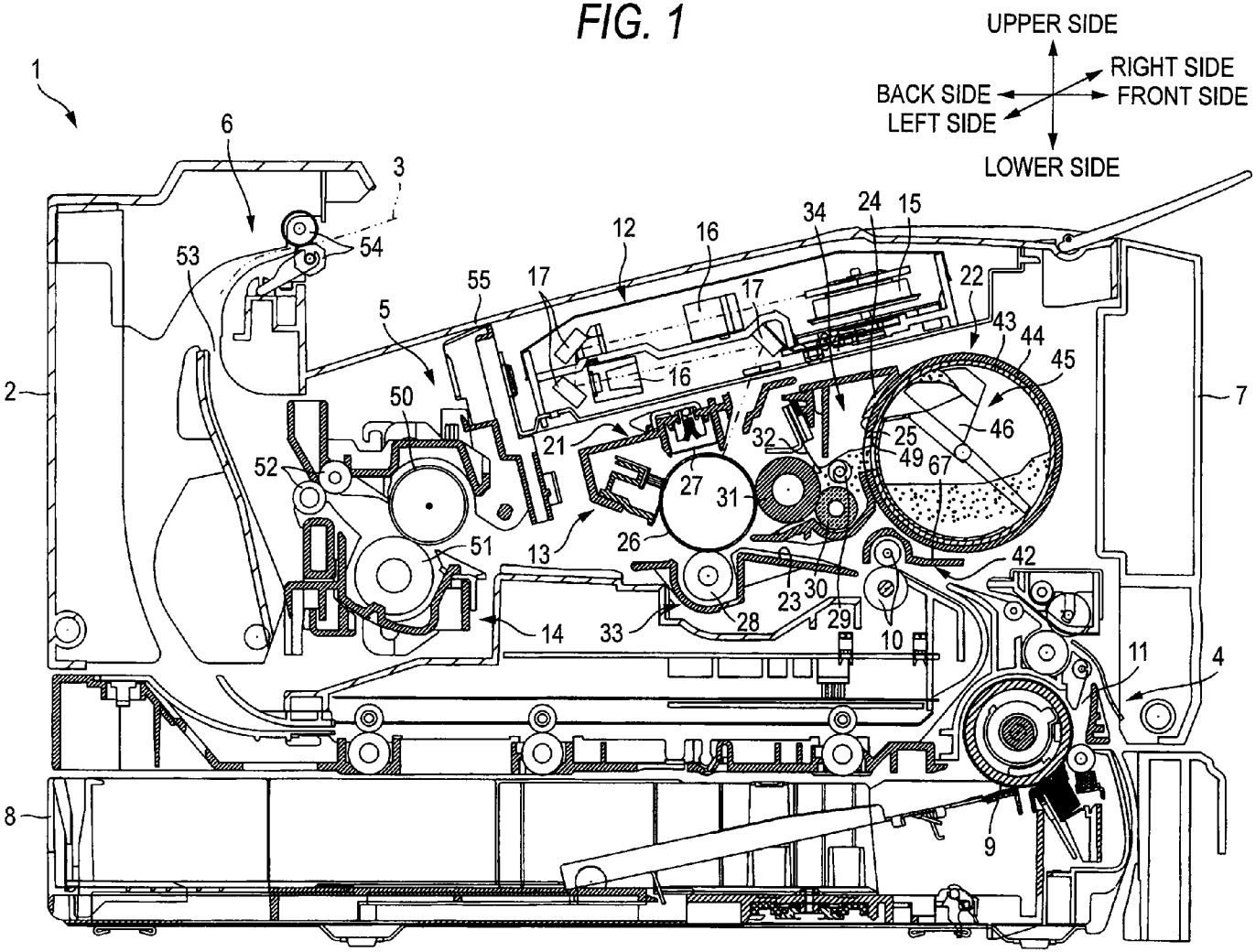
FIG. 1 is an exemplary side sectional view showing an image forming apparatus according to an aspect of the present invention.

According to an aspect of the invention, there is provided a cartridge cabinet including: a developer accommodating chamber configured to accommodate developer; and a supply opening that is provided in one wall surface and is configured to supply the developer from an inside of the developer accommodating chamber to an outside of the developer accommodating chamber; a rotational shaft that is rotatably supported in the cartridge cabinet, extends parallel to the one wall surface and extends through the inside of the developer accommodating chamber; an agitating blade that is supported by the rotational shaft and rotates with the rotational shaft to supply the developer toward the supply opening while agitating the developer; and an obstruction member that is supported by the rotational shaft and rotates with the rotational shaft following the agitating blade to obstruct the supply opening during rotation of the rotational shaft.

According to another aspect of the present invention, there is provided a developing unit including: a developer cartridge including: a cartridge cabinet including: a developer accommodating chamber configured to accommodate developer; and a supply opening that is provided in one wall surface and is configured to supply the developer from an inside of the developer accommodating chamber to an outside of the developer accommodating chamber; a rotational shaft that is rotatably supported in the cartridge cabinet, extends parallel to the one wall surface and extends through the inside of the developer accommodating chamber; an agitating blade that is supported by the rotational shaft and rotates with the rotational shaft to supply the developer toward the supply opening while agitating the developer; and an obstruction member that is supported by the rotational shaft and rotates with the rotational shaft following the agitating blade to obstruct the supply opening during rotation of the rotational shaft; a unit cabinet, the developer cartridge being attachable to and detachable from the unit cabinet, the unit cabinet including: a developing chamber; and an opening that is provided in a wall surface of the unit cabinet, the opening located in a position opposite to the supply opening allowing communication between the inside of the developing chamber and the inside of the developer accommodating chamber, and a developer transport member that is provided inside the developing chamber and is configured to transport the developer supplied from the supply opening and the opening to the inside of the developing chamber in a direction along the rotational shaft.

According to still another aspect of the present invention, there is provided a developing unit including: a cabinet including: a developer accommodating chamber configured to accommodate developer; a bulkhead; a developing chamber separated from the developer accommodating chamber by the bulkhead; and a supply opening that is provided in the bulkhead and is configured to supply the developer from an inside of the developer accommodating chamber to an inside of the developing chamber; a rotational shaft that is provided in the developer accommodating chamber and extends parallel to the bulkhead; an agitating blade that is supported by the rotational shaft and rotates with the rotational shaft to supply the developer to the supply opening while agitating the developer; an obstruction member that is supported by the rotational shaft and rotates with the rotational shaft following the agitating blade to obstruct the supply opening during rotation of the rotational shaft; and a developer transport member that is provided inside the developing chamber and is configured to transport the developer supplied from the supply opening to the inside of the developing chamber in a direction along the rotational shaft.

<Illustrative Aspects>

Illustrative aspects of the invention will be described with reference to the drawings.

In the related art, toner supplied from the toner supply port to the inside of the developing chamber by the agitator is returned from the toner supply port to the inside of the toner cartridge and thereby, the toner is not efficiently supplied from the toner cartridge to the developing chamber.

Therefore, aspects of the present invention provide a developer cartridge, a developing unit and an image forming apparatus capable of efficiently supplying developer from a developer accommodating chamber to an outside thereof.

(Image Forming Apparatus)

FIG. 1 is an exemplary side sectional view showing an image forming apparatus according to an aspect of the present invention. In FIG. 1, the image forming apparatus is embodied in the form of a laser printer by way of an example. However, one of ordinary skill in the art will appreciate that the present inventive concept will apply equally to any apparatus which uses developer for producing images on a recording medium.

An image forming apparatus 1 comprises a feeder unit 4 for feeding a sheet 3, an image forming unit 5 for forming an image on the sheet 3, a sheet discharge part 6 for discharging the sheet 3, and a body casing 2 for housing the feeder unit 4, the image forming unit 5, and the sheet discharge part 6. The body casing 2 is one example of an apparatus body.

(1) Body Casing

The body casing 2 has a substantially box shape. An opening is provided in a sidewall of one side of the body casing 2. A front cover 7 for opening and closing the opening is provided in the sidewall of one side of the casing 2.

Incidentally, in the following description, aside (right side in FIG. 1) where the front cover 7 is provided is referred to as a front side (front face side) and an opposite side (left side in FIG. 1) is referred to as a back side (rear side). Also, in the description that follows, references to upper, lower, left, and right sides of the image forming apparatus 1 are the upper, lower, left and right sides as viewed from the front side of the image forming apparatus 1. Also, a developing unit 13 and a developer cartridge 22 (both described in more detail below) are similarly described using directions in reference to the front side of the image forming apparatus 1.

(2) Feeder Unit

The feeder unit 4 comprises a sheet feeding tray 8, a sheet feeding roller 9, a pair of resister rollers 10, and a sheet feeding path 11. An upper most sheet 3 from an inside of the sheet feeding tray 8 is fed to the sheet feeding path 11 by rotation of the sheet feeding roller 9. The fed sheet 3 is conveyed to the resister rollers 10 through the sheet feeding path 11. The resister rollers 10 feed the sheet 3 toward the image forming unit 5 at proper timing.

(3) Image Forming Unit

The image forming unit 5 comprises a scanner unit 12, a fixing part 14 and a developing unit 13. In FIG. 1, the developing unit 13 is embodied in the form of a process cartridge by way of an example. However, one of ordinary skill in the art will appreciate that the present inventive concept will apply equally to any unit which may be used for developing.

(3-1) Scanner Unit

The scanner unit 12 is arranged in an upper part of inside of the body casing 2. The scanner unit 12 includes a laser light emitting part (not shown), a polygon mirror 15, a lens 16 and a reflecting mirror 17. A laser beam based on data of an image to be formed on the sheet 3 is emitted from the scanner unit 12 and a surface of a photoconductive drum 26 described below is irradiated with its laser beam.

(3-2) Developing Unit

The developing unit 13 is arranged under the scanner unit 12. The developing unit 13 is attachable to and detachable from the body casing 2.

The developing unit 13 comprises a process frame 21 as one example of a unit cabinet, and the developer cartridge 22 is detachably attached to the process frame 21.

Figure 2:
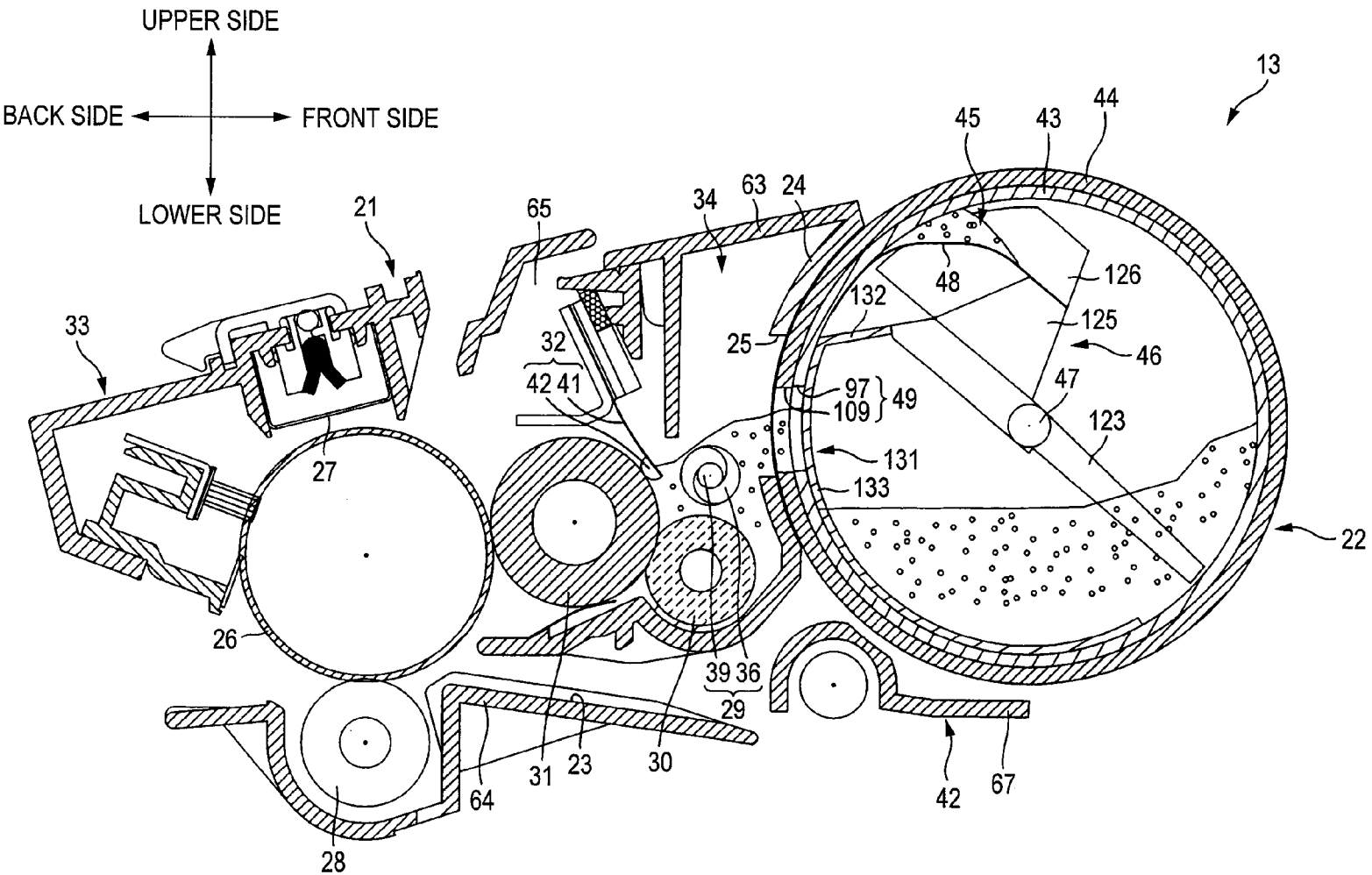
FIG. 2 is an exemplary side sectional view of a developing unit according to an aspect of the present invention wherein the developing unit is in a state in which a developer cartridge according to an aspect of the present invention is attached to a process frame.

FIG. 2 is an exemplary side sectional view of the developing unit 13 according to an aspect of the present invention.

The process frame 21 has a substantially box shape longitudinally in a width direction. A transfer path 23 for guiding the sheet 3 between a transfer roller 28 and the photoconductive drum 26 (described below) is provided in a lower part of the process frame 21.

In the process frame 21, a bulkhead 24 is provided in a middle part of front and back directions. The bulkhead 24 extends in upper and lower directions and in a width direction (left and right directions). A frame side opening 25 is provided in the bulkhead 24.

In the process frame 21, a portion of the process frame 21 on a back side from the bulkhead 24 is a process part 33 for receiving the photoconductive drum 26, an electrification device 27, the transfer roller 28, a developer transport member 29, a supply roller 30, a developing roller 31 and a layer thickness regulating blade 32. In FIG. 2, the developer transport member 29 is embodied in the form of an auger by way of example. However, one of ordinary skill in the art will appreciate that other structures are possible for transferring the developer.

The photoconductive drum 26 and the transfer roller 28 are rotatably supported by the process frame 21. The electrification device 27 is arranged over the photoconductive drum 26. The electrification device 27 may be, for example, a scorotron-type charger for positive electrification. The transfer roller 28 is arranged under the photoconductive drum 26.

A developing chamber 34 is provided inside the portion of about a half of front side of the process part 33. The developer transport member 29, the supply roller 30, the developing roller 31 and the layer thickness regulating blade 32 are arranged inside the developing chamber 34.

The developer transport member 29 is arranged in a position opposed to the frame side opening 25 in a back side of the frame side opening 25 as shown in FIG. 2. The supply roller 30 is arranged under the developer transport member 29. The developing roller 31 is arranged at a back side of the supply roller 30. The developer transport member 29, the supply roller 30 and the developing roller 31 are rotatably supported by the process frame 21.

The layer thickness regulating blade 32 comprises a flexible leaf spring member 41 having a thin plate shape, and a pressure contact rubber 42 disposed at a lower end of the leaf spring member 41. An upper end of the leaf spring member 41 is fixed to the process frame 21 at upper side of the developing roller 31. The pressure contact rubber 42 presses a surface of a rubber roller 40 from the front side by an elastic force of the leaf spring member 41.

In the process frame 21, a portion of the process frame 21 on the front side of the bulkhead 24 forms a cartridge attachment part 42 to which a developer cartridge 22 is attached.

The developer cartridge 22 comprises an inside cabinet 43 and an outside cabinet 44. The inside cabinet 43 and the outside cabinet 44 form a double cylindrical shape in which both ends are closed.

The inside cabinet 43 as one example of a cartridge cabinet provides a developer accommodating chamber 45 for accommodating developer inside the inside cabinet 43. In the image forming apparatus 1 of the aspect, the developer comprises a suspension polymerization toner which is a nonmagnetic one-component toner with positive electrification.

Also, an agitator 46 is disposed inside the developer accommodating chamber 45. The agitator 46 is rotatably supported in the inside cabinet 43. The agitator 46 will be described below in detail.

A cartridge side opening 49 is provided in a surface of the inside cabinet 43 and a surface of the outside cabinet 44 as shown in FIG. 2. The cartridge side opening 49 allows an inside of the developer accommodating chamber 45 to communicate with an outside of the developer accommodating chamber 45 in a state in which the developer cartridge is attached to the cartridge attachment part 42.

Developer the inside of the developer accommodating chamber 45 is agitated by rotation of the agitator 46. Also, by rotation of the agitator 46, the developer of the inside of the developer accommodating chamber 45 is transported to the cartridge side opening 49 and is discharged from the cartridge side opening 49. The developer discharged from the cartridge side opening 49 is supplied to the inside of the developing chamber 34 through the frame side opening 25. The developer supplied to the inside of the developing chamber 34 is supplied to the supply roller 30 while being transported in a width direction by rotation of the developer transport member 29.

The developer supplied to the supply roller 30 is supplied to the developing roller 31 by rotation of its supply roller 30. The developer is frictionally electrified in positive polarity between the supply roller 30 and the developing roller 31. In the developer supplied to the developing roller 31, a layer thickness of the developer is regulated by the pressure contact rubber 42 of the layer thickness regulating blade 32. Consequently, a thin layer of the developer is carried on a surface of the developing roller 31.

In contrast, a surface of the photoconductive drum 26 is positively electrified uniformly by the electrification device 27 with rotation of its photoconductive drum 26. Then, an electrostatic latent image corresponding to an image to be formed on the sheet 3 is formed by irradiating its positively electrified surface of the photoconductive drum 26 with a laser beam from the scanner unit 12 (see FIG. 1).

When the electrostatic latent image formed on the surface of the photoconductive drum 26 is opposed to the developing roller 31 by rotation of the photoconductive drum 26, the positively electrified developer carried on the surface of the developing roller 31 is supplied to the electrostatic latent image (that is, the low electric potential portion exposed by a laser beam among the surface of the photoconductive drum 26 positively electrified uniformly). Consequently, the electrostatic latent image is imaged and transferred and a developer image is carried on the surface of the photoconductive drum 26. The developer image carried on the surface of the photoconductive drum 26 is transferred to the sheet 3 when the sheet 3 conveyed from the resister rollers 10 passes between the photoconductive drum 26 and the transfer roller 28.

(3-3) Fixing Part

The fixing part 14 is disposed at the back side of the developing unit 13 as shown in FIG. 1. The fixing part 14 comprises a heating roller 50, a pressurizing roller 51 brought into pressure contact with the heating roller 50, and a pair of conveying rollers 52 arranged in the back of their rollers.

The developer image transferred to the sheet 3 is fixed to the sheet 3 by heating and pressurizing from the heating roller 50 and the pressurizing roller 51 while the sheet 3 passes between the heating roller 50 and the pressurizing roller 51. The sheet 3 to which the developer image is fixed is conveyed to the sheet discharge part 6 by the pair of conveying rollers 52.

(4) Sheet Discharge Part

The sheet discharge part 6 comprises a sheet discharge path 53, a pair of sheet discharge rollers 54, and a sheet discharge tray 55. The sheet 3 conveyed from the fixing part 14 is conveyed to the sheet discharge path 53 and is discharged on the sheet discharge tray 55 by the sheet discharge rollers 54.

(Developing Unit)

Figure 3:
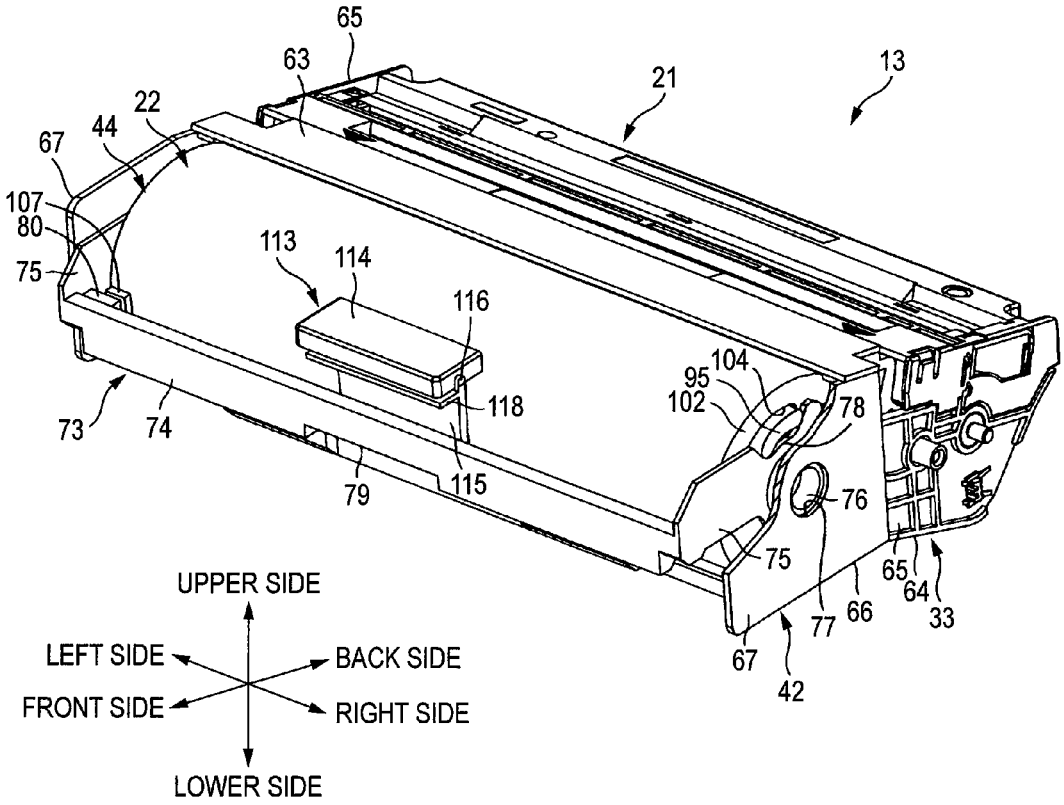
FIG. 3 is a schematic perspective view of the developing unit of FIG. 2 as viewed from a front right side of the developing unit.
Figure 4:
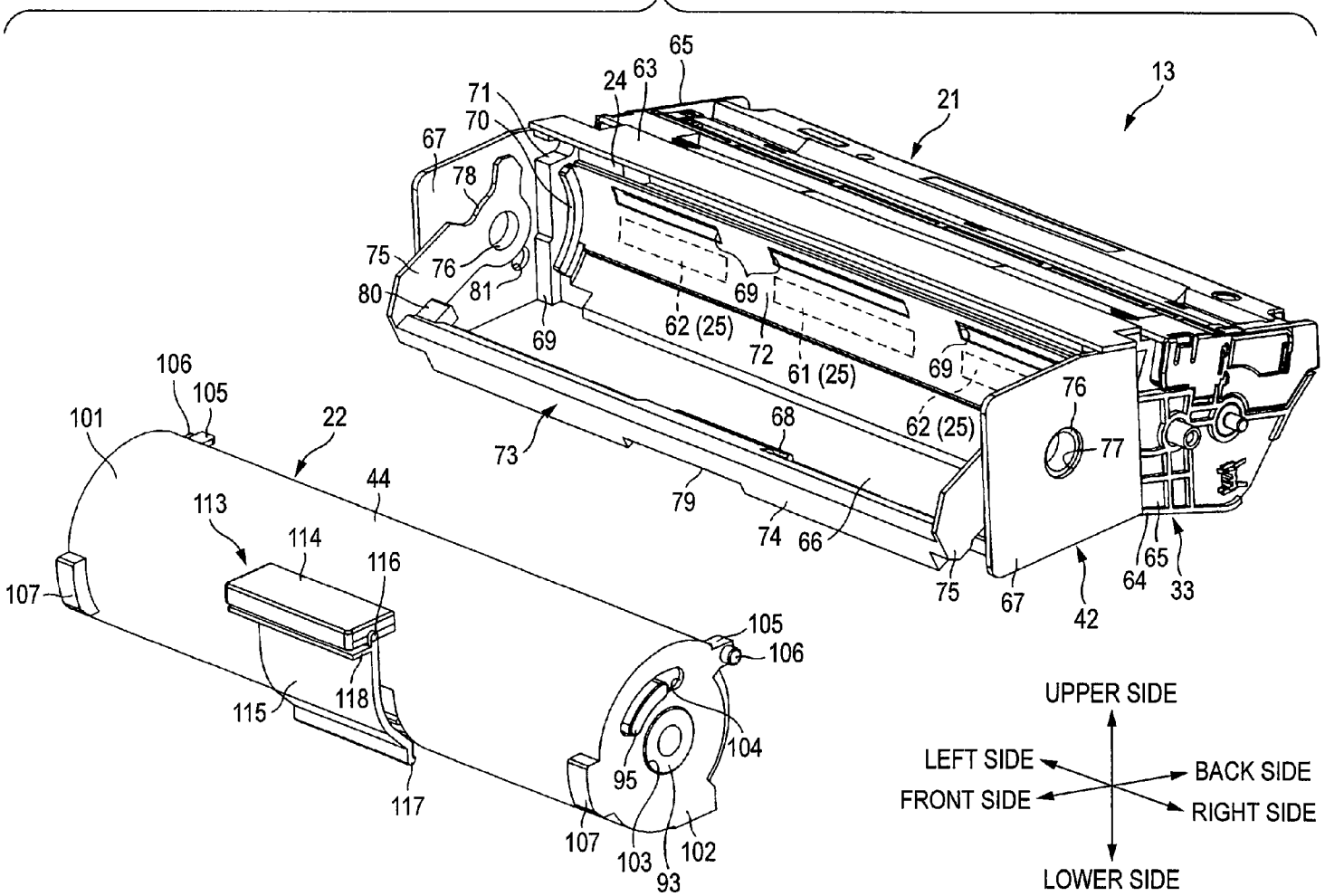
FIG. 4 is an exemplary perspective view, as viewed from the front right side of the developing unit of FIG. 3, showing the developing unit in a state in which the developer cartridge is detached from the process frame.
Figure 5:
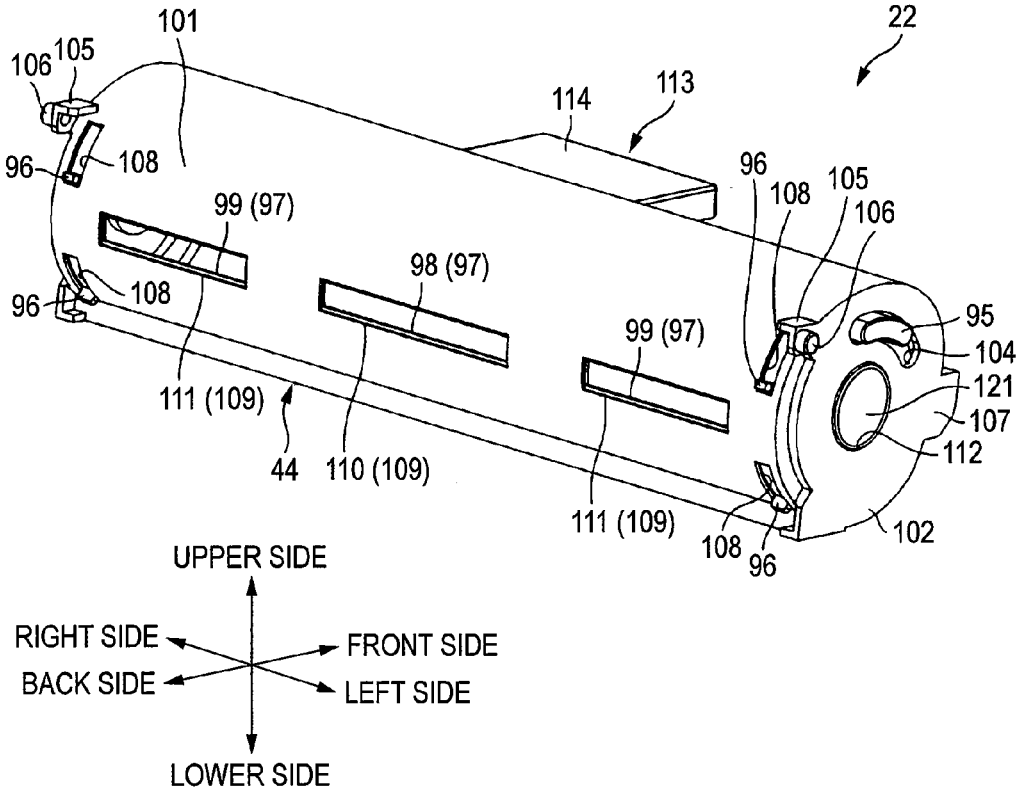
FIG. 5 is an exemplary perspective view of the developer cartridge of FIG. 4, as viewed from a back left side, in a state in which an inside cabinet is in an opened position.
Figure 6:
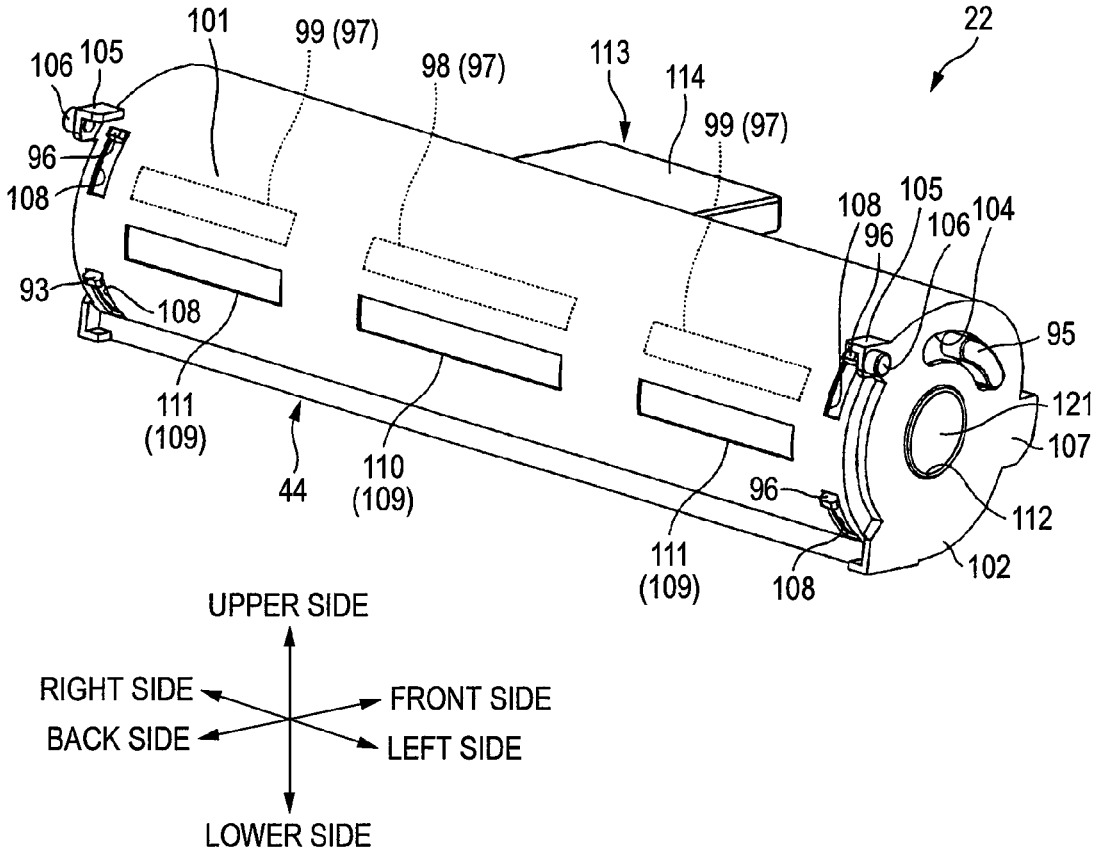
FIG. 6 is an exemplary perspective view of the developer cartridge of FIG. 4, as viewed from the back left side, in a state in which the inside cabinet is in a closed position.
Figure 7:
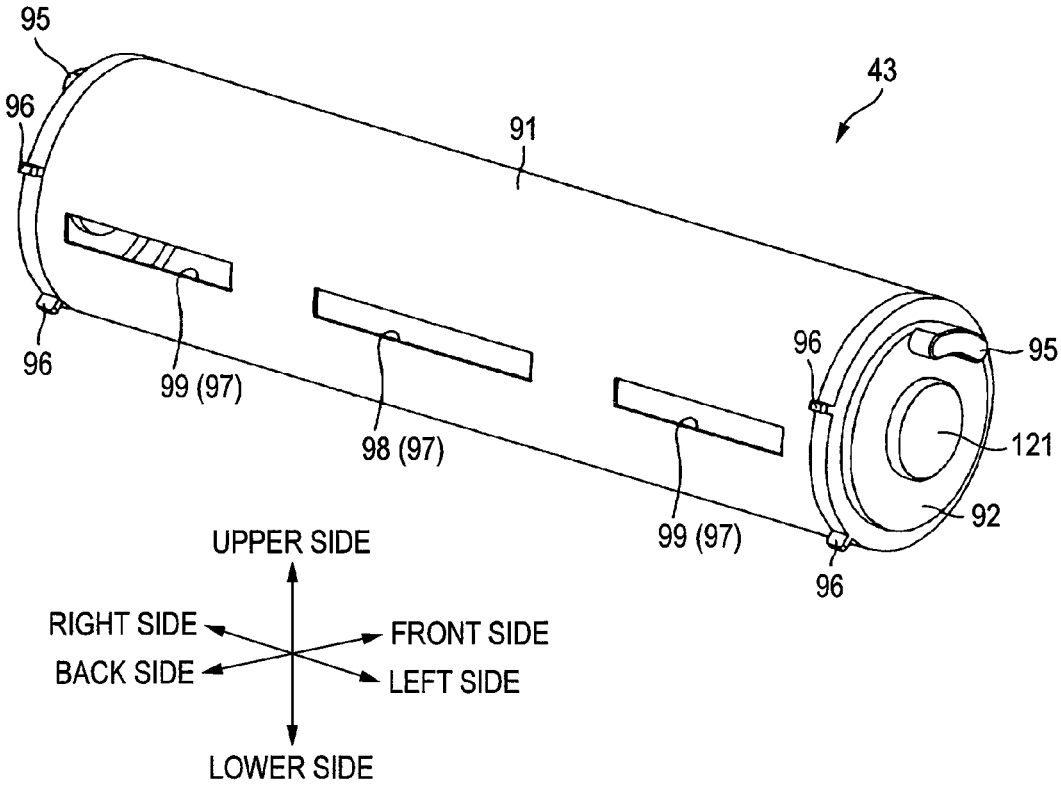
FIG. 7 is an exemplary perspective view, as viewed from a back left side, of the inside cabinet of the developer cartridge of FIG. 4.
Figure 8:
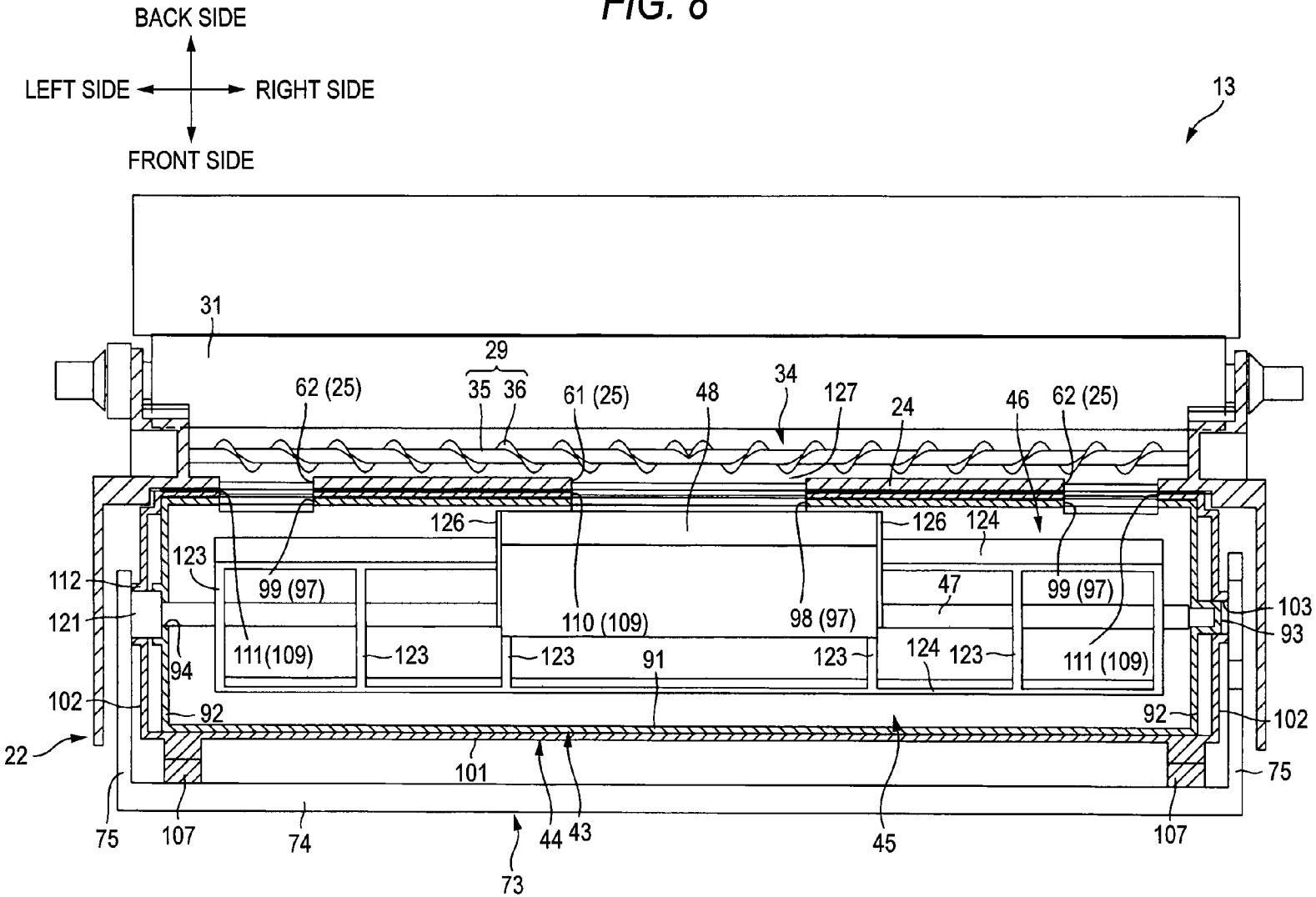
FIG. 8 is an exemplary plan sectional view of the developing unit of FIG. 3.

FIG. 3 is a perspective view viewed from the front right side of the developing unit 13 and shows a state of the developing unit 13 in which the developer cartridge 22 is attached to the process frame 21. FIG. 4 is a perspective view viewed from the front right side of the developing unit 13 and shows a state of the developing unit 13 in which the developer cartridge 22 is detached from the process frame 21. FIGS. 5 and 6 are perspective views viewed from the back left side of the developer cartridge 22. FIG. 7 is a perspective view viewed from the back left side of the inside cabinet 43 of the developer cartridge 22. FIG. 8 is a plan sectional view of the developing unit 13.

(1) Process Frame

The Process frame 21 integrally includes the bulkhead 24, the process part 33 at the back side of the bulkhead 24, and the cartridge attachment part 42 at the front side of the bulkhead 24 as described above.

(1-1) Bulkhead

The bulkhead 24 comprises a curved portion in the middle of the upper and lower directions, as shown in FIG. 2. The curved portion of the bulkhead 24 has a radius of curvature that matches an outer peripheral surface of the developer cartridge 22 as shown in FIG. 2.

Three of the frame side openings 25 are formed in the curved portion of the bulkhead 24 at a spacing in the width direction as shown in FIG. 4.

The frame side opening 25 at a center is a frame side supply opening 61 for supplying developer from the inside of the developer cartridge 22 (i.e., developer accommodating chamber 45) to the inside of the process part 33 (i.e., the developing chamber 34). The frame side supply opening 61 has a substantially rectangular shape longer in a width direction (i.e., a left and right direction) than a width direction of the frame side openings 25 on either side of the frame side supply opening 61.

The frame side openings 25 on either side of the frame side supply opening 61 are frame side return openings 62 for returning developer from the inside of the process part 33 (i.e., from the developing chamber 34) to the inside of the developer cartridge 22 (i.e., inside the developer accommodating chamber 45).

(1-2) Process Part

The process part 33 integrally includes an upper wall 63 extending backward from the upper edge of the bulkhead 24, a bottom wall 64 extending backward from the lower edge of the bulkhead 24, and side walls 65 respectively extending backward from both edges of the width direction of the bulkhead 24. The relationship between the walls of the process part 33 and the bulkhead 24 is most easily seen in FIGS. 2 and 4.

The developer transport member 29 arranged in the process part 33 comprises an developer transport member shaft 35, and a screw 36 disposed around the developer transport member shaft 35 (see FIGS. 2 and 8). The developer transport member shaft 35 extends in the width direction and both ends of the developer transport member shaft 35 are rotatably supported by the side walls 65. The developer transport member shaft 35 is rotated by driving force from a motor (not shown) during an image forming operation. The screws 36 are respectively disposed on both sides with respect to the center of the width direction in the developer transport member shaft 35 and have a substantially spiral shape for transporting developer from the center of the width direction to both outsides of the width direction as shown in FIG. 8.

(1-3) Cartridge Attachment Part

The cartridge attachment part 42 integrally comprises a bottom plate 66 forward extending from the lower edge of the bulkhead 24, and side plates 67 respectively forward extending from both edges of the width direction of the bulkhead 24 as shown in FIG. 4.

The bottom plate 66 is integrally formed continuously with the bottom wall 64 of the process part 33.

A lower side fixed part 68 slightly protruding to the front side is provided in the center of the width direction of the front edge as shown in FIGS. 2 and 4.

Each of the side plates 67 is integrally formed continuously with both the side walls 65 of the process part 33.

A shutter support part 69 is disposed on an inside surface of the width direction of the back end of each of the side plates 67 as shown in FIG. 4. Each of the shutter support parts 69 has a substantially rectangular shape extending in the upper and lower directions and extends inwardly from the inside surface of the width direction of both the side plates 67.

A shutter guide part 70 is disposed on an inside surface of the width direction of each of the shutter support parts 69. Each of the shutter guide parts 70 forms a protrusion stripe extending inwardly from the inside surface of the width direction of the shutter support part 69. Also, each of the shutter guide parts 70 has a substantially curved shape with substantially the same curvature as that of the curved portion of the bulkhead 24. Each of the shutter guide parts 70 is arranged in a position opposed to the curved portion of the bulkhead 24 at a slight spacing from the bulkhead 24 in the front and back directions.

An upper end surface of each of the shutter support parts 69 is arranged in a position slightly lower than the upper edge of each of the side plates 67. The upper end surface of each of the shutter support parts 69 forms an upper side fixed part 71.

Also, a shutter 72 for opening and closing the frame side openings 25 is disposed in the cartridge attachment part 42.

The shutter 72 has a substantially rectangular shape extending in the width direction and has a substantially curved shape with substantially the same curvature as that of the curved portion of the bulkhead 24. The shutter 72 is formed slightly shorter than the shutter guide parts 70 in the upper and lower directions. Also, three shutter opening parts 69, corresponding to each of the frame side openings 25, are provided in the shutter 72.

The shutter 72 is arranged in a position opposed to the curved portion of the bulkhead 24, and both ends of a width direction of the shutter 72 are slidably pinched between the bulkhead 24 and each of the shutter guide parts 70. Consequently, the shutter 72 can slide along each of the shutter guide parts 70 in the upper and lower directions between an opened position (see FIG. 2) in which the frame side openings 25 are opened and a closed position (see FIG. 4) in which the frame side openings 25 are closed. When the shutter 72 is in the opened position, the shutter opening parts 69 in a position corresponding respectively to the frame side openings 25 and each of the frame side openings 25 is opened. When the shutter 72 is in the closed position, the portions of the shutter 72 below the shutter opening parts 69 are in a position corresponding respectively to the frame side openings 25 and each of the frame side openings 25 is closed.

Also, a swing arm 73 is disposed in the cartridge attachment part 42 as shown in FIGS. 3 and 4. The swing arm 73 has a substantially U shape in the case of being viewed from the plane. The swing arm 73 integrally comprises a grasp bar 74 extending in the width direction, and arm side plates 75 extending backward from both ends of the width direction of the grasp bar 74.

A boss 76 protruding outward in the width direction is disposed at the back end of each of the arm side plates 75. Each of the bosses 76 is rotatably supported by a circular hole 77 provided in a center portion of each of the side plates 67.

Also, a receiving recessed part 78 notched so as to be recessed to the lower side is provided in the upper side edge at the back end of each of the arm side plates 75.

A grasp part 79 recessed to the upper side is provided in the center portion of the width direction of the grasp bar 74. Also, backward extending press protrusion parts 80 with rectangular shapes in the case of being viewed from the rear are disposed in both ends of the width direction of the grasp bar 74.

Using the boss 76 of each of the arm side plates 75 as a fulcrum, the swing arm 73 swings between a pressing release position (see FIG. 4) in which the lower edge of each of the arm side plates 75 makes contact with the front edge of the bottom plate 66 and a pressing position (see FIGS. 2 and 3) in which the developer cartridge 22 is pressed from the front side if the developer cartridge 22 is received in the cartridge attachment part 42.

(2) Developer Cartridge

The developer cartridge 22 comprises the inside cabinet 43 for accommodating developer, and the outside cabinet 44 for receiving the inside cabinet 43 as described above.

(2-1) Inside Cabinet

The inside cabinet 43 integrally comprises a cylindrical inside peripheral wall 91 extending in the width direction, and circular plate-shaped inside side walls 92 for closing both ends of the width direction of the inside peripheral wall 91 as shown in FIG. 7.

A boss part 93 with a circular thick plate shape extending outward in the width direction is disposed in the center portion of the right inside side wall 92 as shown in FIG. 8.

A shaft through hole 94 through which an agitator shaft 47 described below is passed is provided in the center portion of the left inside side wall 92.

A slide protrusion 95 is disposed in an upper side portion of each of the inside sidewalls 92. The slide protrusion 95 has a substantially circular arc shape (circular arc shape with a center angle of about 45°) in the case of being viewed from the side along an outer peripheral surface of the inside side wall 92, and is disposed so as to protrude from the inside side wall 92 to the outside of the width direction.

Also, a pair of pinch protrusions 96 radially protruding from a peripheral end surface are disposed in a back side portion of each of the inside side walls 92. The pair of pinch protrusions 96 are arranged at a spacing (spacing corresponding to a circumferential length of the shutter 72) in a circumferential direction mutually in the peripheral end surface of each of the inside side walls 92.

In the inside peripheral wall 91, three inside passage openings 97 are formed at a spacing in the width direction in a portion of the inside peripheral wall 91 surrounded by a rectangle with the corners of the pair of pinch protrusions 96 (i.e., there are four pinch protrusions 96) arranged in both sides of the width direction.

Each of the inside passage openings 97 has a substantially rectangular shape elongated in the width direction.

The inside passage opening 97 of the center is an inside supply opening 98 as one example of a supply opening for supplying developer from the inside of the developer cartridge 22 (i.e., the developer accommodating chamber 45) to the inside of the process part 33 (i.e., the developing chamber 34).

The inside passage openings 97 on either side of the inside supply opening 98 are inside return openings 99 for returning developer from the inside of the process part 33 (i.e., the developing chamber 34) to the inside of the developer cartridge 22 (i.e., the developer accommodating chamber 45).

(2-2) Outside Cabinet

The outside cabinet 44 is formed slightly larger than the inside cabinet 43 in the width and radial directions in order that the outside cabinet 44 may rotatably receive the inside cabinet 43. The outside cabinet 44 integrally comprises an outside peripheral wall 101 with substantially a cylindrical shape extending in the width direction, and circular plate-shaped outside side walls 102 for closing both ends of the width direction of the outside peripheral wall 101 as shown in FIG. 6.

A circular boss hole 103 for receiving the boss part 93 is provided in the right outside side wall 102 as shown in FIG. 8.

A cylindrical shaft receiving part 112 for receiving the end of the agitator shaft 47 protruding from the shaft through hole 94 of the left inside side wall 92 to the outside of the width direction is provided in the left outside side wall 102.

Also, a slide hole 104 into which the slide protrusion 95 is inserted is provided in each of the outside side walls 102. The slide hole 104 has a circular arc shape (e.g., a circular arc shape with a center angle of about 90°) with a circumferential length longer than that of the slide protrusion 95 in the case of being viewed from the side, and extends between an upper front side and an upper back side of the boss hole 103.

Also, a backward protruding upper side part 105 to be fixed is formed on a peripheral end surface of each of the outside side walls 102. A positioning boss 106 outward protruding in the width direction is disposed in the back end of each of the upper side parts 105 to be fixed.

Also, a forward extending pressed part 107 is disposed on the peripheral end surface of each of the outside side walls 102 as shown in FIG. 4. Each of the pressed parts 107 has a substantially rectangular shape in the case of being viewed from the front and substantially a circular arc shape in the case of being viewed from the side.

Four elongated holes 108 into which the pairs of pinch protrusions 96 (i.e., there are four pinch protrusions 96) are respectively inserted are provided at both ends of the width direction in the outside peripheral wall 101 as shown in FIG. 6. Each of the elongated holes 108 has a substantially rectangular shape extending in the upper and lower directions when viewed from the rear and has a length corresponding to a swing range between the opened position and the closed position of the shutter 72.

Also, in the outside peripheral wall 101, three outside passage openings 109 are formed at a spacing in the width direction in a portion of the outside peripheral wall 101 surrounded by a rectangle with corners at the four elongated holes 108.

Each of the outside passage openings 109 has a substantially rectangular shape elongated in the width direction.

The outside passage opening 109 of the center is an outside supply opening 110 for supplying developer from the inside of the developer cartridge 22 (i.e., the developer accommodating chamber 45) to the inside of the process part 33 (i.e., the developing chamber 34).

The outside passage openings 109 of both sides of the outside supply opening 110 are outside return openings 111 for returning developer from the inside of the process part 33 (i.e., the developing chamber 34) to the inside of the developer cartridge 22 (i.e., the developer accommodating chamber 45).

The outside supply opening 110 corresponds to the frame side supply opening 61 and is located in a position opposite to the frame side supply opening 61, and each of the outside return openings 111 corresponds to respective frame side return openings 62 in a state in which the developer cartridge 22 is attached to the process frame 21 as shown in FIG. 2.

Also, in the front side of the outside peripheral wall 101, a grip part 113 is disposed in the center of the width direction as shown in FIG. 4.

The grip part 113 comprises an upper grasp plate 114 with a substantially rectangular shape protruding forward from the outside peripheral wall 101, and a locking arm 115 with a substantially J shape in the case of being viewed from the side downward extending from the upper grasp plate 114. The upper end of the locking arm 115 is swingably supported by a support shaft 116 disposed in the upper grasp plate 114. A locking claw 117 for locking in the lower side fixed part 68 is disposed in the lower end of the locking arm 115. A lower grasp plate 118 with a substantially rectangular shape protruding forward is disposed in the vicinity of the upper end of the locking arm 115. The lower grasp plate 118 is arranged so as to extend in a space parallel with the upper grasp plate 114.

A compression spring (not shown) for urging the upper and lower grasp plates in a direction of separation is interposed between the upper grasp plate 114 and the lower grasp plate 118.

(2-3) Relative Arrangement of Inside Cabinet and Outside Cabinet

The inside cabinet 43 is rotatably received inside the outside cabinet 44.

More specifically, an outer peripheral surface of the inside peripheral wall 91 is inward fitted slidably in a circumferential direction with respect to an inner peripheral surface of the outside peripheral wall 101. Also, outer peripheral surfaces of both the inside side walls 92 are inward fitted slidably in a circumferential direction with respect to inner peripheral surfaces of both the outside side walls 102. The boss part 93 is rotatably supported in the boss hole 103 as shown in FIGS. 5 and 6. The end of the agitator shaft 47 is rotatably supported in the shaft receiving part 112. The slide protrusion 95 is inserted into the slide hole 104. Each of the pinch protrusions 96 is inserted into each of the elongated holes 108, and each of the pinch protrusions 96 is protruded from each of the elongated holes 108 to the outside of a radial direction.

The inside cabinet 43 permits relative rotates using the end of the agitator shaft 47 and the boss part 93 as a fulcrum between a closed position (see FIG. 6) in which the inside passage openings 97 are not opposed to the outside passage openings 109 and an opened position (see FIG. 5) in which the inside passage openings 97 are opposed to the outside passage openings 109 with respect to the outside cabinet 44.

When the inside cabinet 43 is in the closed position, each of the slide protrusions 95 is arranged in the front end of each of the slide holes 104 as shown in FIG. 6. Also, each of the pinch protrusions 96 is arranged in the upper end of each of the elongated holes 108. The inside passage openings 97 are arranged in a position above the outside passage openings 109, and the outside passage openings 109 are closed by the inside peripheral wall 91 of the inside cabinet 43.

The inside cabinet 43 is relatively rotated in a direction (lower side) in which the inside passage openings 97 move toward the outside passage openings 109 with respect to the outside cabinet 44 using the end of the agitator shaft 47 and the boss part 93 as a fulcrum. Then, each of the slide protrusions 95 slides each of the slide holes 104 from the front end toward the back end. Also, each of the pinch protrusions 96 slides each of the elongated holes 108 from the upper end toward the lower end.

When each of the slide protrusions 95 abuts on the back edge of each of the slide holes 104 and each of the pinch protrusions 96 abuts on the lower edge of each of the elongated holes 108, the inside cabinet 43 is arranged in the opened position as shown in FIG. 5.

When the inside cabinet 43 is in the opened position, each of the slide protrusions 95 is arranged in the back end of each of the slide holes 104. Also, each of the pinch protrusions 96 is arranged in the lower end of each of the elongated holes 108. Then, the inside passage openings 97 are opposed to the outside passage openings 109 and these passage openings communicate with each other and are opened.

In addition, when the inside cabinet 43 is returned to the closed position, the inside cabinet 43 is relatively rotated in a direction in which the inside passage openings 97 rise from the outside passage openings 109 with respect to the outside cabinet 44 using the end of the agitator shaft 47 and the boss part 93 as the fulcrum.

(3) Attachment and Detachment of Developer Cartridge to and from Process Frame (3-1) Attachment of Developer Cartridge to Process Frame Referring to FIG. 4, when the developer cartridge 22 is attached to the process frame 21, the upper grasp plate 114 and the lower grasp plate 118 of the grip part 113 are pinched in a direction in which the grasp plates move near to each other. Then, the developer cartridge 22 is attached to the cartridge attachment part 42 of the process frame 21. The inside cabinet 43 of the developer cartridge 22 is arranged in the closed position. Also, the shutter 72 of the cartridge attachment part 42 is arranged in the closed position. The swing arm 73 is arranged in a pressing release position.

When the developer cartridge 22 is attached to the cartridge attachment part 42, each of the positioning bosses 106 is placed on each of the upper side fixed parts 71 and a pair of the pinch protrusions 96 (see FIGS. 5 and 6) on both sides in the width direction respectively pinch the upper edge and the lower edge on both ends in the width direction of the shutter 72 and each of the slide protrusions 95 is fitted into each of the receiving recessed parts 78.

Thereafter, when the pinch of the grip part 113 is released, the locking claw 117 is locked in the lower side fixed part 68 as shown in FIG. 2.

The outside cabinet 44 is fixed to the cartridge attachment part 42 since the positioning bosses 106 are placed to the upper side fixed parts 71 (see FIG. 4) and the locking claw 117 is locked to the lower side fixed part 68.

The swing arm 73 is swung from the pressing release position to a pressing position. Each of the press protrusion parts 80 presses each of the pressed parts 107 toward the back side as shown in FIGS. 2 and 3. Consequently, the developer cartridge 22 is pressed toward the process part 33.

Also, when the swing arm 73 is swung from the pressing release position to the pressing position, with swing of each of the arm side plates 75, each of the slide protrusions 95 fitted into each of the receiving recessed parts 78 slides each of the slide holes 104 to the back side and is arranged in the back end of each of the slide holes 104. Further, with the shutter 72 pinched, a pair of the pinch protrusions 96 on both sides in the width direction slides each of the elongated holes 108 to the lower side and is arranged in the lower end of each of the elongated holes 108 (see FIG. 5).

Consequently, the inside cabinet 43 is arranged in the opened position as shown in FIG. 2. Then, the inside passage openings 97 are opposed to the outside passage openings 109 and these passage openings are communicated and opened and thereby, the cartridge side opening 49 is formed.

At the time of forming an image, by an agitating blade 48 of the agitator 46 described below, developer of the inside of the developer accommodating chamber 45 (i.e., in the inside cabinet 43) is transported to the cartridge side opening 49 made of the inside supply opening 98 and the outside supply opening 110 as shown by arrows in FIG. 8 and is discharged from the cartridge side opening 49. The developer discharged from the cartridge side opening 49 is supplied to the inside of the developing chamber 34 (i.e., to the process part 33) through the frame side supply opening 61.

By the developer transport member 29, the developer supplied from the frame side supply opening 61 to the inside of the process part 33 is transported from the center of the width direction to both sides of the width direction and is supplied to the supply roller 30 on the way. The developer supplied to the supply roller 30 is supplied to the developing roller 31 as described above. The developer which has not been supplied to the supply roller 30 is transported to the frame side return openings 62 and passes through the cartridge side opening 49 made of the inside return openings 99 and the outside return openings 111 and is returned to the inside of the developer accommodating chamber 45. Consequently, the developer is circulated between the developing chamber 34 and the developer accommodating chamber 45.

(3-2) Detachment of Developer Cartridge from Process Frame

When the developer cartridge 22 is detached from the process frame 21, the swing arm 73 is first swung from the pressing position to the pressing release position. Then, each of the press protrusion parts 80 is separated from each of the pressed part 107 and a press of the developer cartridge 22 on the process part 33 is released.

Also, when the swing arm 73 is swung from the pressing position to the pressing release position, with swing of each of the arm side plates 75, each of the slide protrusions 95 fitted into each of the receiving recessed parts 78 slides each of the slide holes 104 to the front side and is arranged in the front end of each of the slide holes 104 as shown in FIG. 6. Further, with the shutter 72 pinched, a pair of the pinch protrusions 96 on both sides in the width direction slides each of the elongated holes 108 to the upper side and is arranged in the upper end of each of the elongated holes 108.

Consequently, the inside cabinet 43 is arranged in the closed position, and the inside peripheral wall 91 of the inside cabinet 43 is opposed to the outside passage openings 109, and the outside passage openings 109 are closed. Also, the shutter 72 is arranged in the closed position, and the frame side openings 25 are opposed to the shutter 72 and are closed.

When the upper grasp plate 114 and the lower grasp plate 118 of the grip part 113 are pinched in a direction in which the grasp plates move near to each other, the locking mechanism of the locking claw 117 to the lower side fixed part 68 is released, so that when the developer cartridge 22 is pulled from the cartridge attachment part 42 to the front side, the developer cartridge 22 is detached from the process frame 21 as shown in FIG. 4.

(4) Agitator

Figure 9:
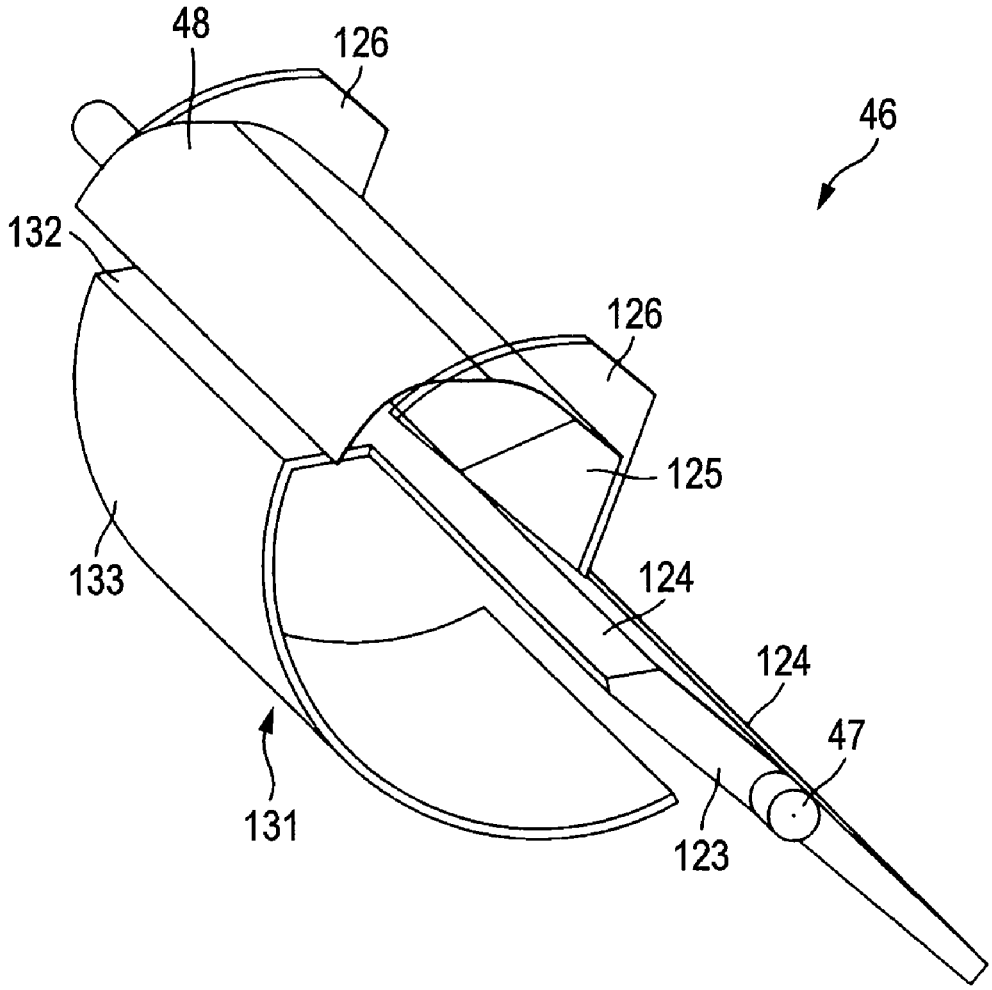
FIG. 9 is an exemplary perspective view of an agitator.

FIG. 9 is an exemplary perspective view of the agitator 46.

The agitator 46 is disposed inside the inside cabinet 43 (i.e., the developer accommodating chamber 45) as shown in FIG. 8. The agitator 46 comprises the agitator shaft 47 as one example of a rotational shaft, an agitating blade 48 supported by the agitator shaft 47, and an obstruction member 131 supported by the agitator shaft 47.

The right end of the agitator shaft 47 is rotatably held by the boss part 93 of the inside cabinet 43.

The agitator shaft 47 extends through the shaft through hole 94 of the inside cabinet 43. An agitator coupling gear 121 to which driving force from a motor (not shown) is inputted is coupled to the left end of the agitator shaft 47. Then, the agitator coupling gear 121 is rotatably held by the shaft receiving part 112 of the outside cabinet 44. The agitator shaft 47 rotates in a direction in which the agitating blade 48 moves from the lower side to the upper side with respect to the inside supply port 98 by the driving force from the motor (not shown) during the image forming operation.

A plurality of support bars 123 are supported by the agitator shaft 47 inside the developer accommodating chamber 45. The support bars 123 have substantially same length in a direction orthogonal to the agitator shaft 47. The support bars 123 are arranged in parallel at equal spacing in the width direction along the agitator shaft 47 on the same plane.

Joint bars 124 are installed astride the range between one end and the other end of each of the support bars 123. Consequently, the support bars 123 and the joint bars 124 are integrally formed and form a ladder-shaped structure supported by the agitator shaft 47.

An agitating blade support member 125 having a substantially trapezoidal shape as viewed from the side is formed on the ladder-shaped structure as shown in FIG. 9. The agitating blade support member 125 is disposed astride a center portion of a width direction of one joint bar 124 and the support bars 123 connected to the center portion of the width direction.

Also, movement preventive walls 126 for preventing movement of the developer in the width direction are formed in both sides of the width direction of the agitating blade support member 125. The movement preventive wall 126 is disposed so as to extend in a direction orthogonal to the agitator shaft 47 along a side surface of the agitating blade support member 125. The movement preventive wall 126 is formed in substantially a trapezoidal shape larger than the agitating blade support member 125 in the case of being viewed from the side.

The agitating blade 48 is made of a flexible film such as a resin film. The agitating blade 48 is formed in substantially a rectangular shape. Then, in the agitating blade 48, one end of its longitudinal direction is fixed to the agitating blade support member 125 and the other end opposite to one end is formed in the free end.

The obstruction member 131 is made of the same rigid resin material as that of the support bar 123 and is formed integrally with the support bar 123 for supporting the agitating blade support member 125. The obstruction member 131 integrally comprises a proximal end part 132 with substantially a rectangular plate shape extending from the center portion of the width direction of the support bar 123, and an opposed part 133 extending from the top edge of the proximal end part 132 toward the upstream side of a rotational direction of the agitator 46.

As described above, the agitating blade 48 and the obstruction member 131 are supported by the agitator shaft 47 extending through the inside of the developer accommodating chamber 45. With rotation of the agitator shaft 47, the agitating blade 48 rotates preceding the obstruction member 131 and the obstruction member 131 rotates following the agitating blade 48. Consequently, after the developer is supplied toward the inside supply opening 98 by the agitating blade 48, the obstruction member 131 following the agitating blade 48 obstructs the inside supply opening 98, and the developer supplied to the outside (developing chamber 34) can be prohibited from returning to the inside of the developer accommodating chamber 45 while the obstruction member 131 obstructs the inside supply opening 98. As a result of that, the developer can be supplied from the inside of the developer accommodating chamber 45 to the outside efficiently.

Then, the toner transport member 29 for transporting the developer in a direction along the agitator shaft 47 is mounted inside the developing chamber 34 which is the outside, so that the developer supplied from the inside supply opening 98 to the inside of the developing chamber 34 can well be transported in the width direction. As a result of that, smoother circulation of the developer between the developer accommodating chamber 45 and the developing chamber 34 can be ensured.

Also, the movement preventive walls 126 for preventing movement of the developer in the direction along the agitator shaft 47 are disposed in both sides of the direction along the agitator shaft 47 with respect to the agitating blade 48. As a result, the developer pushed by the agitating blade 48 can be prevented from escaping in the direction along the agitator shaft 47 when the developer is supplied toward the inside supply opening 98 by the agitating blade 48. As a result of that, the developer of the inside of the developer accommodating chamber 45 can be supplied from the inside supply opening 98 to the outside more efficiently.

Further, the agitating blade 48 is made of a flexible film, so that the agitating blade 48 can be deformed along an inner surface shape of the developer accommodating chamber 45. As a result, developer can be prevented from being retained in the bottom of the inside of the developer accommodating chamber 45. On the other hand, the obstruction member 131 is made of a rigid resin, so that the obstruction member 131 can well obstruct and stop a flow of the developer without being deformed even when the developer returned from the inside supply opening 98 to the inside of the developer accommodating chamber 45 collides in the case of being opposed to the inside supply opening 98.

Also, the inside return openings 99 for returning the developer from the outside to the inside of the developer accommodating chamber 45 are formed in the inside peripheral wall 91 of the inside cabinet 43. As a result, circulation of the developer between the developer accommodating chamber 45 and its outside can be achieved by returning the developer from the outside to the inside of the developer accommodating chamber 45 through the inside return openings 99 while the developer is supplied from the inside of the developer accommodating chamber 45 to the outside through the inside supply opening 98.

By rotation of the agitator shaft 47, the agitating blade 48 rotates in a direction of moving from the lower side to the upper side with respect to the inside supply opening 98. As a result, the developer scraped up by the agitating blade 48 can be fed out of the inside supply opening 98 before dropping from the agitating blade 48. As a result of that, the developer can be supplied from the inside of the developer accommodating chamber 45 to the outside more efficiently.

MODIFIED EXAMPLES

(1) Modified Example of Obstruction Member

Figure 10:
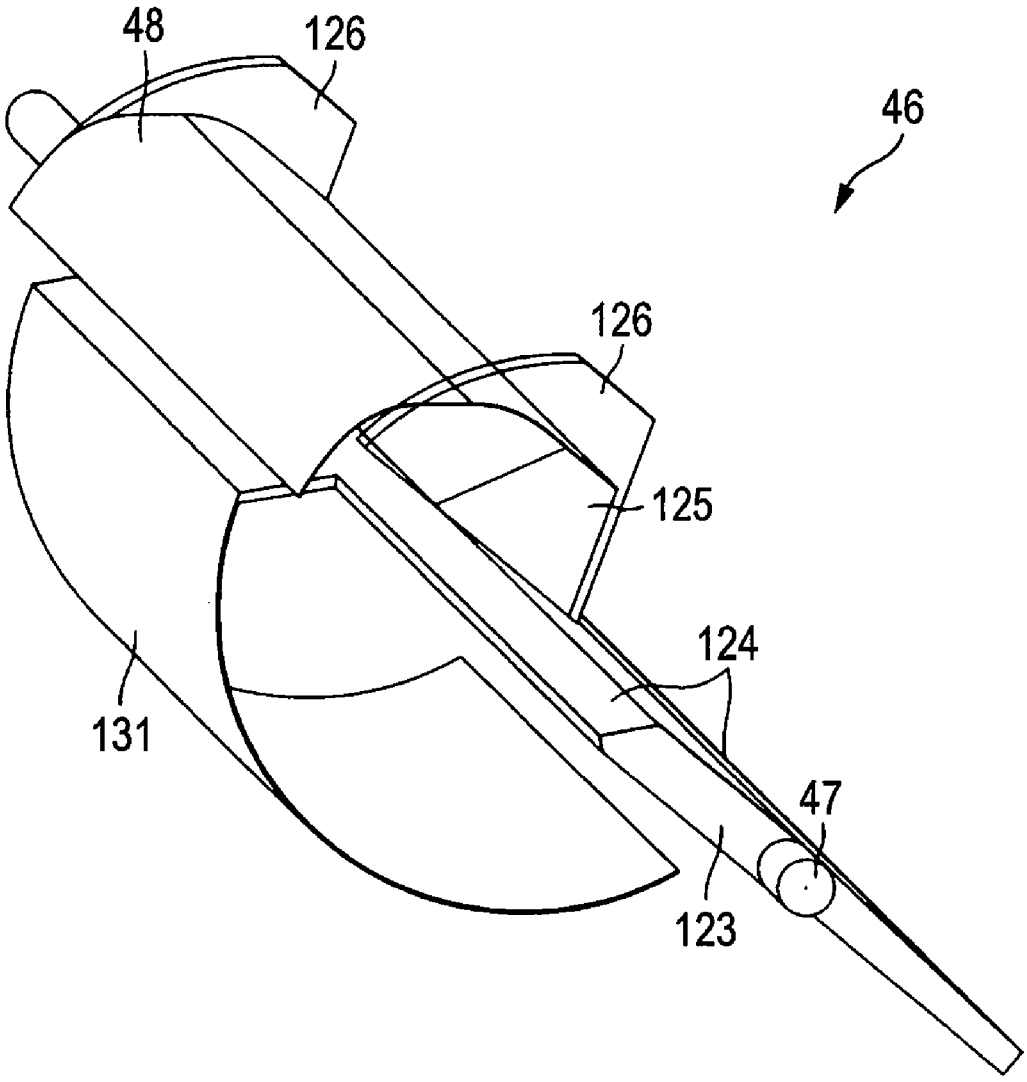
FIG. 10 is an exemplary perspective view of a modified example of the agitator.

FIG. 10 is an exemplary perspective view of a modified example of the agitator 46 (obstruction member 131). In FIG. 10, the same reference numerals as each part are assigned to the portions corresponding to each part shown in FIG. 9. Also, detailed description of each part to which the same reference numerals are assigned is omitted below.

In the agitator 46 shown in FIG. 10, the obstruction member 131 is made of a flexible film such as a resin film. The obstruction member 131 is formed in substantially a rectangular shape. A length of a longitudinal direction (a direction orthogonal to an agitator shaft 47) of the obstruction member 131 is longer than a length of a longitudinal direction of an agitating blade 48. Also, the length of the longitudinal direction of the obstruction member 131 is longer than the sum of a length of the inside supply opening 98 in a rotational direction of the agitator shaft 47 and a linear distance (a distance in the direction orthogonal to the agitator shaft 47) between the agitator shaft 47 and the inside supply opening 98 (see FIG. 8).

As a result of that, when the obstruction member 131 is opposed to the inside supply opening 98, the obstruction member 131 is deformed along a shape of the periphery of the inside supply opening 98 and the whole area of the inside supply opening 98 can be obstructed surely.

(2) Modified Example of Developing Unit

Figure 11:
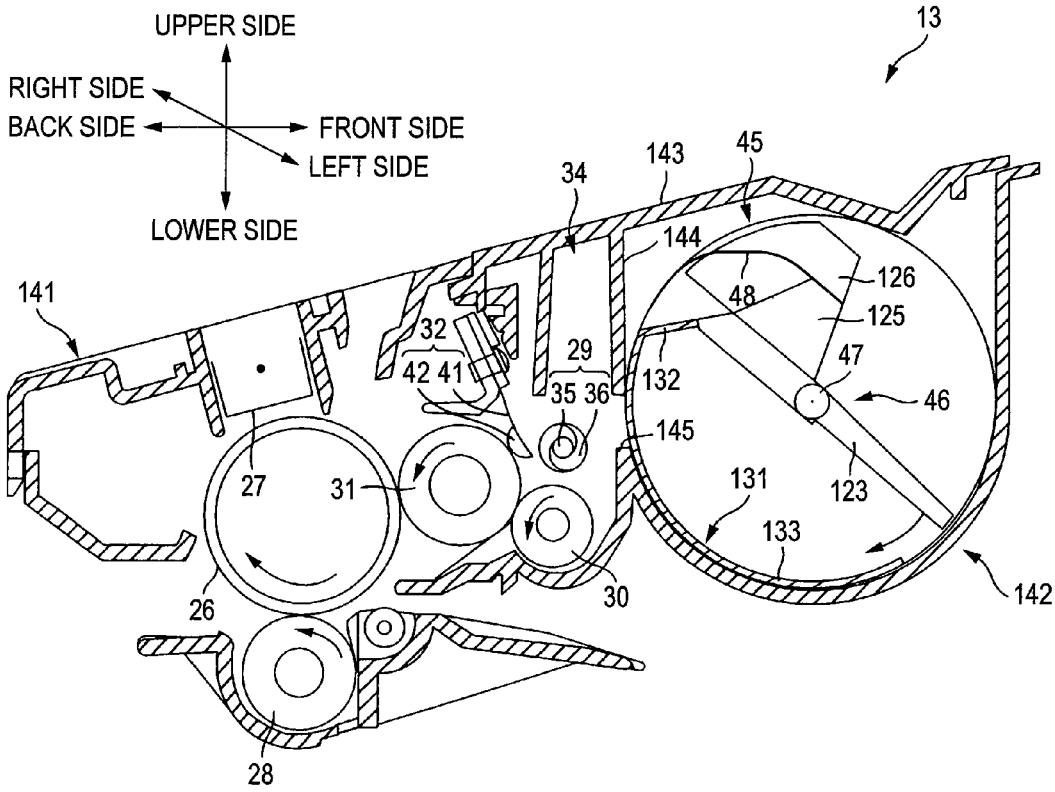
FIG. 11 is an exemplary side sectional view of a modified example of the developing unit.

FIG. 11 is an exemplary side sectional view of a modified example of the developing unit 13. In FIG. 11, the same reference numerals as each part are assigned to the portions corresponding to each part shown in FIG. 2. Also, detailed description of each part to which the same reference numerals are assigned is omitted below.

The developing cartridge 13 shown in FIG. 11 comprises a drum cartridge 141 for holding a photoconductive drum 26, an electrification device 27 and a transfer roller 28, and a developing cartridge 142 for holding a toner transport member 29, a supply roller 30, a developing roller 31, a layer thickness regulating blade 32 and an agitator 46.

The developing cartridge 142 is constructed attachably to and detachably from the drum cartridge 141. The developing cartridge 142 comprises a cabinet 143 formed in a box shape in which the back side is opened.

Inside the cabinet 143, a developer accommodating chamber 45 and a developing chamber 34 are formed in a state of being arranged backward and forward.

A bulkhead 144 is formed between the developer accommodating chamber 45 and the developing chamber 34 and by the bulkhead 144, the developer accommodating chamber 45 is separated from the developing chamber 34.

Also, three openings 145 are formed in the bulkhead 144 at a spacing in a width direction in a manner similar to the cartridge side opening 49 in the developing cartridge 13 shown in FIG. 2. The opening 145 of the center is a supply opening for supplying the developer from the inside of the developer accommodating chamber 45 to the inside of the developing chamber 34. The openings 145 of both sides are return openings for returning the developer from the inside of the developing chamber 34 to the inside of the developer accommodating chamber 45.

(3) Additional Examples

In FIG. 11, the photoconductive drum 26, the electrification device 27 and the transfer roller 28 may be mounted inside a body casing 2 rather than a form of the drum cartridge 141.

Further, although aspects of the present inventive concept have been described in relation to a laser printer, the present inventive concept is not limited to a monochrome laser printer. Rather, the present inventive concept can also be applied to a color laser printer, including a tandem type and an intermediate transfer type printer.

What is claimed is:

1. A developer cartridge comprising:

a cartridge cabinet comprising:

a developer accommodating chamber configured to accommodate developer; and a supply opening that is provided in one wall surface and is configured to supply the developer from inside of the developer accommodating chamber to outside of the developer accommodating chamber;

a rotational shaft that is rotatably supported in the cartridge cabinet, extends parallel to the one wall surface and extends through the inside of the developer accommodating chamber;

an agitating blade that is made of a film and supported by the rotational shaft and rotates with the rotational shaft to supply the developer toward the supply opening while agitating the developer; and an obstruction member that is made of a rigid resin and supported by the rotational shaft and rotates with the rotational shaft following the agitating blade to obstruct the supply opening during rotation of the rotational shaft, wherein the one wall surface comprises a return opening configured to return the developer from the outside of the developer accommodating chamber to the inside of the developer accommodating chamber.

2. The developer cartridge according to claim 1, further comprising:

a movement preventive wall that is supported by the rotational shaft and provided at both sides of a direction along the rotational shaft with respect to the agitating blade to prevent movement of the developer in the direction along the rotational shaft.

3. The developer cartridge according to claim 1, wherein the obstruction member has flexibility and is formed longer than the agitating blade in a direction orthogonal to the rotational shaft.

4. The developer cartridge according to claim 3, wherein a length of the obstruction member in a direction orthogonal to the rotational shaft is longer than a sum of a length of the supply opening in a rotational direction of the rotational shaft and a distance between the rotational shaft and the supply opening.

5. The developer cartridge according to claim 1, wherein the rotational shaft is rotatable in a direction in which the agitating blade moves from the lower side to the upper side with respect to the supply opening.

6. A developing unit comprising:

a developer cartridge comprising:

a cartridge cabinet comprising:

a developer accommodating chamber configured to accommodate developer; and a supply opening that is provided in one wall surface and is configured to supply the developer from inside of the developer accommodating chamber to outside of the developer accommodating chamber;

a rotational shaft that is rotatably supported in the cartridge cabinet, extends parallel to the one wall surface and extends through the inside of the developer accommodating chamber;

an agitating blade that is made of a film and supported by the rotational shaft and rotates with the rotational shaft to supply the developer toward the supply opening while agitating the developer; and an obstruction member that is made of a rigid resin and supported by the rotational shaft and rotates with the rotational shaft following the agitating blade to obstruct the supply opening during rotation of the rotational shaft, wherein the one wall surface comprises a return opening configured to return the developer from the outside of the developer accommodating chamber to the inside of the developer accommodating chamber; a unit cabinet, the developer cartridge being attachable to and detachable from the unit cabinet, the unit cabinet comprising:

a developing chamber; and an opening that is provided in a wall surface of the unit cabinet, the opening located in a position opposite to the supply opening allowing communication between the inside of the developing chamber and the inside of the developer accommodating chamber, and a developer transport member that is provided inside the developing chamber and is configured to transport the developer supplied from the supply opening and the opening to the inside of the developing chamber in a direction along the rotational shaft.

7. A developing unit comprising:

a cabinet comprising:

a developer accommodating chamber configured to accommodate developer;

a bulkhead;

a developing chamber separated from the developer accommodating chamber by the bulkhead; and a supply opening that is provided in the bulkhead and is configured to supply the developer from inside of the developer accommodating chamber to inside of the developing chamber;

a rotational shaft that is provided in the developer accommodating chamber and extends parallel to the bulkhead;

an agitating blade that is made of a film and supported by the rotational shaft and rotates with the rotational shaft to supply the developer to the supply opening while agitating the developer;

an obstruction member that is made of a rigid resin and supported by the rotational shaft and rotates with the rotational shaft following the agitating blade to obstruct the supply opening during rotation of the rotational shaft; and a developer transport member that is provided inside the developing chamber and is configured to transport the developer supplied from the supply opening to the inside of the developing chamber in a direction along the rotational shaft, wherein the bulkhead comprises a return opening configured to return the developer from the inside of the developing chamber to the inside of the developer accommodating chamber.

8. The developing unit according to claim 7, further comprising:

a movement preventive wall that is supported by the rotational shaft and provided at both sides of a direction along the rotational shaft with respect to the agitating blade to prevent movement of the developer in the direction along the rotational shaft.

9. The developing unit according to claim 7, wherein the obstruction member has flexibility and is formed longer than the agitating blade in a direction orthogonal to the rotational shaft.

10. The developing unit according to claim 9, wherein a length of the obstruction member in a direction orthogonal to the rotational shaft is longer than the sum of a length of the supply opening in a rotational direction of the rotational shaft and a distance between the rotational shaft and the supply opening.

11. The developing unit according to claim 7, wherein the rotational shaft is rotatable in a direction in which the agitating blade moves from the lower side to the upper side with respect to the supply opening.

12. A developer cartridge comprising:

a housing that has a wall defining a developer accommodating chamber elongated in a first direction and configured to accommodate developer, the wall having first and second holes that are arranged substantially along the first direction;

a shaft that is located in the developer accommodating chamber and rotatably supported by the housing;

an agitating blade that is made of a film and supported by the shaft, the agitating blade facing the first hole and not facing the second hole while the shaft is rotating; and a frame that is made of a rigid resin and supported by the shaft, the frame configured to rotate following the agitating blade, the frame obstructing the first hole and not obstructing the second hole while the shaft is rotating.

13. The developer cartridge according to claim 12, wherein the frame is longer than the agitating blade in a second direction orthogonal to the first direction.

* * * * *